US005376287A

United States Patent [19]

Borcher, Sr. et al.

[11] Patent Number: 5,376,287

[45] Date of Patent: Dec. 27, 1994

[54] DRYER-ACTIVATED FABRIC CONDITIONING COMPOSITIONS CONTAINING ETHOXYLATED/PROPOXYLATED SUGAR DERIVATIVES

[75] Inventors: Thomas A. Borcher, Sr., Cincinnati; Alessandro Corona, III, Maineville; Willis A. Sturdivant; Stephanie L. Sung, both of Cincinnati, all of Ohio; David M. Wojcik, Green Bay, Wis.

[73] Assignee: The Procter & Gamble Company, Cincinnati, Ohio

[21] Appl. No.: 102,910

[22] Filed: Aug. 6, 1993

[51] Int. Cl.[5] ..... D06M 10/08

[52] U.S. Cl. ..... 252/8.8; 252/8.6; 252/8.9

[58] Field of Search ..... 252/8.6, 8.8, 8.9

[56] References Cited

U.S. PATENT DOCUMENTS

| | | | |
|---|---|---|---|
| 3,896,033 | 7/1975 | Grimm, III | 252/8.8 |
| 3,993,571 | 11/1976 | Marshall | 252/8.9 |
| 4,134,839 | 1/1979 | Marshall | 252/8.6 |
| 4,460,644 | 7/1984 | Pavlich | 428/314.4 |
| 4,970,008 | 11/1990 | Kandathil | 252/8.8 |
| 5,080,810 | 1/1992 | Smith et al. | 252/8.8 |
| 5,093,014 | 3/1992 | Neillie | 252/8.8 |
| 5,094,761 | 3/1992 | Trinh et al. | 252/8.8 |
| 5,102,564 | 4/1992 | Gardlik et al. | 252/8.8 |
| 5,139,687 | 8/1992 | Borgher, Sr. et al. | 252/8.8 |
| 5,234,610 | 8/1993 | Gardlik et al. | 252/8.8 |
| 5,236,615 | 8/1993 | Trinh et al. | 252/8.8 |

FOREIGN PATENT DOCUMENTS

| | | |
|---|---|---|
| 0354011A1 | 2/1990 | European Pat. Off. . |
| 0409504A2 | 1/1991 | European Pat. Off. . |

*Primary Examiner*—Anthony Green
*Attorney, Agent, or Firm*—Robert B. Aylor

[57] ABSTRACT

Dryer-activated fabric softening compositions and articles having improved antistatic effects, for use in an automatic clothes dryer comprising: (A) at least about 5% of highly ethoxylated, preferably at least 5 ethylene oxide (EO) groups per molecule, sugar derivative containing at least one long hydrophobic moiety per molecule; and, preferably, (B) from about 10% to about 95%, of carboxylic acid salt of tertiary amine. The amount of (A) present is at least sufficient to provide improved antistatic effects and is not so much as to cause the composition to have unacceptable physical characteristics, e.g., stickiness. The active components (A) and (B) can contain unsaturation to provide improved antistatic benefits.

29 Claims, No Drawings

DRYER-ACTIVATED FABRIC CONDITIONING COMPOSITIONS CONTAINING ETHOXYLATED/PROPOXYLATED SUGAR DERIVATIVES

TECHNICAL FIELD

The present invention relates to an improvement in dryer activated, e.g., dryer-added, softening products, compositions, and/or the process of making these compositions. These products and/or compositions are either in particulate form, compounded with other materials in solid form, e.g., tablets, pellets, agglomerates, etc., or, preferably, attached to a substrate.

SUMMARY OF THE INVENTION

The present invention relates to dryer-activated fabric softening compositions and articles having improved antistatic effects, for use in an automatic clothes dryer. These compositions and/or articles comprise, as essential ingredients:

(A) at least about 5%, preferably from about 10% to about 90%, more preferably from about 10% to about 75%, and even more preferably from about 15% to about 55%, of highly ethoxylated and/or propoxylated, preferably at least 5 ethylene oxide (EO) and/or propylene oxide (PO) groups per molecule, more preferably at least about 10, and even more preferably at least about 15, EO groups per molecule, sugar derivative containing at least one long hydrophobic moiety per molecule; and, preferably, (B) from 0% to about 95%, preferably from about 10% to about 75%, more preferably from about 20% to about 60%, of a carboxylic acid salt of a tertiary amine.

The amount of (A) present is at least sufficient to provide improved antistatic effects and is not so much as to cause the composition to have unacceptable physical characteristics, e.g., stickiness. The active components (A) and (B) can contain unsaturation to provide improved antistatic benefits.

DETAILED DESCRIPTION OF THE INVENTION

The present invention relates to fabric softening compositions and articles having improved antistatic effects, for use in an automatic clothes dryer. These compositions comprise, as essential ingredients:

(A) at least about 5%, preferably from about 10% to about 90%, more preferably from about 10% to about 75%, and even more preferably from about 15% to about 55%, of highly ethoxylated and/or propoxylated, preferably at least 5 EO or PO groups per molecule, more preferably at least about 10, and even more preferably 15, EO groups per molecule, sugar derivative containing at least one long hydrophobic moiety per molecule; and, preferably, (B) from 0% to about 95%, preferably from about 10% to about 75%, more preferably from about 20% to about 60%, of a carboxylic acid salt of a tertiary amine.

The active components can contain unsaturation for additional antistatic benefits. The components are selected so that the resulting fabric treatment composition has a melting point above about 38° C. and is flowable at dryer operating temperatures.

(A) The Ethoxylated/Propoxylated Sugar Derivative

The ethoxylated and/or propoxylated sugar derivative contains a "sugar" moiety, e.g., a moiety derived from, e.g., a polyhydroxy sugar, or sugar alcohol, that contains from about 4 to about 12 hydroxy groups. This sugar moiety is substituted by at least one long hydrophobic group, containing from about 8 to about 30 carbon atoms, preferably from about 16 to about 18 carbon atoms. For improved physical characteristics, e.g., higher melting point, the hydrophobic group can contain more carbon atoms, e.g., 20–22, and/or there can be more than one hydrophobic group, preferably two or, less preferably, three. In general, it is preferred that the hydrophobic group is supplied by esterifying one of the hydroxy groups with a fatty acid. However, the hydrophobic group can be supplied by esterifying the hydroxy group to connect the hydrophobic group to the sugar moiety by an ether linkage, and/or a moiety containing a carboxy group esterified with a fatty alcohol can be attached to the sugar moiety to provide the desired hydrophobic group.

Sugar moieties include sucrose, galactose, mannose, glucose, fructose, sorbitan, sorbitol, mannitol, inositol, etc., and/or their derivatives such as glucosides, galactosides, etc. Other "sugar" types of moieties containing multiple hydroxy groups can also be used including starch fractions and polymers such as polyglycerols. The sugar moiety is any polyhydroxy group that provides the requisite number of hydroxy groups.

The hydrophobic group can be provided by attachment with an ester, ether, or other linkage that provides a stable compound. The hydrophobic group is preferably primarily straight chain, and preferably contains some unsaturation to provide additional antistatic benefits. Such hydrophobic groups and their sources are well known, and are described hereinafter with respect to the more conventional types of softening agents.

The polyalkoxy chain can be all ethoxy groups, and/or can contain other groups such as propoxy, glyceryl ether, etc., groups. In general, polyethoxy groups are preferred, but for improved properties such as biodegradability, glyceryl ether groups can be inserted. Typically there are from about 5 to about 100, preferably from about 10 to about 40, more preferably from about 15 to about 30, ethoxy groups, or their equivalents, per molecule.

An empirical formula is as follows:

$$R_m\text{-(sugar)}(R^1O)_n$$

wherein R is a hydrophobic group containing from about 8 to about 30, preferably from about 12 to about 22, more preferably from about 16 to about 18 carbon atoms; "sugar" refers to a polyhydroxy group, preferably derived from a sugar, sugar alcohol, or similar polyhydroxy compound; $R^1$ is an alkylene group, preferably ethylene or propylene, more preferably ethylene; m is a number from 1 to about 4, preferably 2; and n is a number from about 5 to about 100, preferably from about 10 to about 40. A preferred compound of this type is polyethoxylated sorbitan monostearate, e.g., Glycosperse ® S-20 from Lonza, which contains about 20 ethoxylate moieties per molecule.

The level of the polyethoxy sugar derivative is typically at least about 5%, preferably at least about 10%, more preferably at least about 15%. Preferably the maximum level is no more than about 90%, more preferably no more than about 75%.

The polyethoxy sugar derivative provides improved antistatic properties to the compositions and can provide equivalent anti-static properties to conventional dryer added compositions, and/or articles, even with less, or no, quaternary ammonium softener materials present. It is possible to prepare a dryer-added composition, or article, that is entirely nonionic.

(B) Co-Softener

Fabric softening compositions employed herein contain, as a preferred component, at a level of from about 10% to about 95%, preferably from about 20% to about 75%, more preferably from about 20% to about 60%, carboxylic acid salt of a tertiary amine which has the formula:

$$R^5—N(R^6)(R^7)—H(+)(-)O—C(O)—R^8$$

wherein $R^5$ is a long chain aliphatic group containing from about 8 to about 30 carbon atoms; $R^6$ and $R^7$ are the same or different from each other and are selected from the group consisting of aliphatic groups containing from about 1 to about 30 carbon atoms, hydroxyalkyl groups of the Formula $R^4OH$ wherein $R^4$ is an alkylene group of from about 2 to about 30 carbon atoms, and alkyl ether groups of the formula $R^9O(C_nH_{2n}O)_m$ wherein $R^9$ i s alkyl and alkenyl of from about 1 to about 30 carbon atoms and hydrogen, n is 2 or 3, and m is from about 1 to about 30, and wherein $R^8$ is selected from the group consisting of unsubstituted alkyl, alkenyl, aryl, alkaryl and aralkyl of about 1 to about 30 carbon atoms, and substituted alkyl, alkenyl, aryl, alkaryl, and aralkyl of from about 1 to about 30 carbon atoms wherein the substituents are selected from the group consisting of halogen, carboxyl, and hydroxyl, said composition having a melting point of from about 35° C. to about 100° C.

This component can provide the following benefits: superior odor, a decrease in paint softening of the dryer drum, and/or improved fabric softening performance, compared to similar articles without this component. Either $R^5$, $R^6$, $R^7$, and/or $R^8$ chains can contain unsaturation for improved antistatic benefits.

Tertiary amine salts of carboxylic acids have superior chemical stability, compared to primary and secondary amine carboxylate salts. For example, primary and secondary amine carboxylates tend to form amides when heated, e.g., during processing or use in the dryer. Also, they absorb carbon dioxide, thereby forming high melting carbamates which build up as an undesirable residue on treated fabrics.

Preferably, $R^5$ is an aliphatic chain containing from about 12 to about 30 carbon atoms, $R^6$ is an aliphatic chain of from about 1 to about 30 carbon atoms, and $R^7$ is an aliphatic chain of from about 1 to about 30 carbon atoms. Particularly preferred tertiary amines for static control performance are those containing unsaturation; e.g., oleyldimethylamine and/or soft tallowdimethylamine.

Examples of preferred tertiary amines as starting material for the reaction between the amine and carboxylic acid to form the tertiary amine salts are: lauryldimethylamine, myristyldimethylamine, stearyldimethylamine, tallowdimethylamine, coconutdimethylamine, dilaurylmethylamine, distearylmethylamine, ditallowmethylamine, oleyldimethylamine, dioleyl methylamine, lauryldi(3-hydroxypropyl)amine, stearyldi(2-hydroxyethyl)amine, trilaurylamine, laurylethylmethylamine, and $C_{18}H_{37}N[(OC_2H_4)_{10}OH]_2$.

Preferred fatty acids are those wherein $R^8$ is a long chain, unsubstituted alkyl or alkenyl group of from about 8 to about 30 carbon atoms, more preferably from about 11 to about 17 carbon atoms. Examples of specific carboxylic acids as a starting material are: formic acid, acetic acid, lauric acid, myristic acid, palmitic acid, stearic acid, oleic acid, oxalic acid, adipic acid, 12-hydroxy stearic acid, benzoic acid, 4-hydroxy benzoic acid, 3-chloro benzoic acid, 4-nitro benzoic acid, 4-ethyl benzoic acid, 4-(2-chloroethyl)benzoic acid, phenylacetic acid, (4-chlorophenyl)acetic acid, (4-hydroxyphenyl)acetic acid, and phthalic acid.

Preferred carboxylic acids are stearic, oleic, lauric, myristic, palmitic, and mixtures thereof.

The amine salt can be formed by a simple addition reaction, well known in the art, disclosed in U.S. Pat. No. 4,237,155, Kardouche, issued Dec. 2, 1980. Excessive levels of free amines may result in odor problems, and generally free amines provide poorer softening performance than the amine salts.

Preferred amine salts for use herein are those wherein the amine moiety is a $C_8$–$C_{30}$ alkyl or alkenyl dimethyl amine or a di-$C_8$–$C_{30}$ alkyl or alkenyl methyl amine, and the acid moiety is a $C_8$–$C_{30}$ alkyl or alkenyl monocarboxylic acid. The amine and the acid, respectively, used to form the amine salt will often be of mixed chain lengths rather than single chain lengths, since these materials are normally derived from natural fats and oils, or synthetic processed which produce a mixture of chain lengths. Also, it is often desirable to utilize mixtures of different chain lengths in order to modify the physical or performance characteristics of the softening composition.

Specific preferred amine salts for use in the present invention are oleyldimethylamine stearate, stearyldimethylamine stearate, stearyldimethylamine myristate, stearyldimethylamine palmitate, distearylmethylamine palmitate, distearylmethylamine laurate, and mixtures thereof. A particularly preferred mixture is oleyldimethylamine stearate and distearylmethylamine myristate, in a ratio of 1:10 to 10:1, preferably about 1:1.

(C) Optional Ingredients

Well known optional components included in fabric conditioning compositions are narrated in U.S. Pat. No. 4,103,047, Zaki et al., issued Jul. 25, 1978, for "Fabric Treatment Compositions," incorporated herein by reference.

(1) Optional Nonionic Softener

A highly preferred optional ingredient is a nonionic fabric softening agent/material. Typically, such nonionic fabric softener materials have an HLB of from about 2 to about 9, more typically from about 3 to about 7. In general, the materials selected should be relatively crystalline, higher melting, (e.g., >25° C.).

The level of optional nonionic softener in the solid composition is typically from about 10% to about 50%, preferably from about 15% to about 40%.

Preferred nonionic softeners are fatty acid partial esters of polyhydric alcohols, or anhydrides thereof, wherein the alcohol, or anhydride, contains from about 2 to about 18, preferably from about 2 to about 8, carbon atoms, and each fatty acid moiety contains from about 8 to about 30, preferably from about 16 to about 20, carbon atoms. Typically, such softeners contain from about one to about 3, preferably about 2 fatty acid groups per molecule.

The polyhydric alcohol portion of the ester can be ethylene glycol, glycerol, poly (e.g., di-, tri-, tetra, penta-, and/or hexa-) glycerol, xylitol, sucrose, erythritol, pentaerythritol, sorbitol or sorbitan. These nonionic fabric softening materials do not include the ethoxylated sugar derivatives disclosed hereinbefore. They typically contain no more than about 4 ethoxy groups per molecule.

The fatty acid portion of the ester is normally derived from fatty acids having from about 8 to about 30, preferably from about 16 to about 20, carbon atoms. Typical examples of said fatty acids being lauric acid, myristic acid, palmitic acid, stearic acid, oleic acid, and behenic acid.

Highly preferred optional nonionic softening agents for use in the present invention are $C_{10}$–$C_{26}$ acyl sorbitan esters and polyglycerol monostearate. Sorbitan esters are esterified dehydration products of sorbitol. The preferred sorbitan ester comprises a member selected from the group consisting of $C_{10}$–$C_{26}$ acyl sorbitan monoesters and $C_{10}$–$C_{26}$ acyl sorbitan diesters and ethoxylates of said esters wherein one or more of the unesterified hydroxyl groups in said esters contain from 1 to about 4 oxyethylene units, and mixtures thereof. For the purpose of the present invention, sorbitan esters containing unsaturation (e.g., sorbitan monooleate) are preferred.

Sorbitol, which is typically prepared by the catalytic hydrogenation of glucose, can be dehydrated in well known fashion to form mixtures of 1,4- and 1,5-sorbitol anhydrides and small amounts of isosorbides. (See U.S. Pat. No. 2,322,821, Brown, issued Jun. 29, 1943, incorporated herein by reference.)

The foregoing types of complex mixtures of anhydrides of sorbitol are collectively referred to herein as "sorbitan." It will be recognized that this "sorbitan" mixture will also contain some free, uncyclized sorbitol.

The preferred sorbitan softening agents of the type employed herein can be prepared by esterifying the "sorbitan" mixture with a fatty acyl group in standard fashion, e.g., by reaction with a fatty acid halide, fatty acid ester, and/or fatty acid. The esterification reaction can occur at any of the available hydroxyl groups, and various mono-, di-, etc., esters can be prepared. In fact, mixtures of mono-, di-, tri-, etc., esters almost always result from such reactions, and the stoichiometric ratios of the reactants can be simply adjusted to favor the desired reaction product.

For commercial production of the sorbitan ester materials, etherification and esterification are generally accomplished in the same processing step by reacting sorbitol directly with fatty acids. Such a method of sorbitan ester preparation is described more fully in MacDonald; "Emulsifiers:" Processing and Quality Control:, *Journal Of the American Oil Chemists' Society*, Vol. 45, October 1968.

Details, including formula, of the preferred sorbitan esters can be found in U.S. Pat. No. 128,484, incorporated hereinbefore by reference.

For the purposes of the present invention, it is preferred that a significant amount of di- and tri- sorbitan esters are present in the ester mixture. Ester mixtures having from 20–50% mono-ester, 25–50% di-ester and 10–35% of tri- and tetra-esters are preferred.

The material which is sold commercially as sorbitan monoester (e.g., monostearate) does in fact contain significant amounts of di- and tri-esters and a typical analysis of commercial sorbitan monostearate indicates that it comprises about 27% mono-, 32% di- and 30% tri- and tetra-esters. Commercial sorbitan monostearate therefore is a preferred material. Mixtures of sorbitan stearate and sorbitan palmitate having stearate/palmitate weight ratios varying between 10:1 and 1:10, and 1,5-sorbitan esters are useful. Both the 1,4- and 1,5-sorbitan esters are useful herein.

Other useful alkyl sorbitan esters for use in the softening compositions herein include sorbitan monolaurate, sorbitan monomyristate, sorbitan monopalmitate, sorbitan monobehenate, sorbitan monooleate, sorbitan dilaurate, sorbitan dimyristate, sorbitan dipalmitate, sorbitan distearate, sorbitan dibehenate, sorbitan dioleate, and mixtures thereof, and mixed tallowalkyl sorbitan mono- and di-esters. Such mixtures are readily prepared by reacting the foregoing hydroxy-substituted sorbitans, particularly the 1,4- and 1,5-sorbitans, with the corresponding acid or acid chloride in a simple esterification reaction. It is to be recognized, of course, that commercial materials prepared in this manner will comprise mixtures usually containing minor proportions of uncyclized sorbitol, fatty acids, polymers, isosorbide structures, and the like. In the present invention, it is preferred that such impurities are present at as low a level as possible.

The preferred sorbitan esters employed herein can contain up to about 15% by weight of esters of the $C_{20}$–$C_{26}$, and higher, fatty acids, as well as minor amounts of $C_8$, and lower, fatty esters.

Suitable compositions herein contain the essential ingredients (A) and (B) as described hereinbefore and additionally comprise, as ingredient (C), from about 15% to about 40% of $C_{10}$–$C_{26}$ acyl sorbitan monoester, diester, or mixtures thereof; wherein the composition has a melting point of from about 50° C. to about 80° C. Optionally, the compositions contain from 0% to about 2% of a stabilizer selected from the group consisting of ascorbic acid, ascorbic palmitate, propyl gallate, butylated hydroxytoluene, tertiary butylhydroquinone, natural tocopherols, butylated hydroxyanisole, citric acid, isopropyl citrate, and mixtures thereof; and from 0% to about 10% of a soil release polymer; or mixtures thereof, the ratio of A:B:C preferably being about 1:1.56:2.

Glycerol and polyglycerol esters, especially glycerol, diglycerol, triglycerol, and polyglycerol mono- and/or di- esters, preferably mono-, are also preferred herein (e.g., polyglycerol monostearate with a trade name of Radiasurf® 7248). Glycerol esters can be prepared from naturally occurring triglycerides by normal extraction, purification and/or interesterification processes or by esterification processes of the type set forth hereinbefore for sorbitan esters. Partial esters of glycerin can also be ethoxylated with no more than about 4 ethoxy groups per molecule to form usable derivatives that are included within the term "glycerol esters."

Useful glycerol and polyglycerol esters include mono-esters with stearic, oleic, palmitic, lauric, isostearic, myristic, and/or behenic acids and the diesters of stearic, oleic, palmitic, lauric, isostearic, behenic, and/or myristic acids. It is understood that the typical mono-ester contains some di- and tri-ester, etc.

The "glycerol esters" also include the polyglycerol, e.g., diglycerol through octaglycerol esters. The polyglycerol polyols are formed by condensing glycerin or epichlorohydrin together to link the glycerol moieties via ether linkages. The mono- and/or diesters of the polyglycerol polyols are preferred, the fatty acyl groups typically being those described hereinbefore for the sorbitan and glycerol esters.

2. Quaternary Ammonium Compound

Compositions of the present invention can contain from 0% to about 20%, preferably from 0% to about 10%, more preferably from 0% to about 5%, and even more preferably from about 1% to about 5%, of quaternary ammonium compound, preferably ester, and/or amide linked.

The quaternary ammonium compounds are typically of the Formulas I, II, and mixtures thereof.

Formula I comprises:

$$(R)_{4-m}—N^{\oplus}—[(CH_2)_n—(Y)_p—R^2]_mX^{\ominus}$$

wherein each Y=—O—(O)C—, —N(R)$^3$—C(O)—, —C(O)—N(R)$^3$—, or —C(O)—O—; m=1 to 3; n=1 to 4; p=0 or 1; each R substituent is a short chain $C_1$–$C_6$, preferably $C_1$–$C_3$, alkyl or hydroxy alkyl group, e.g., methyl (most preferred), ethyl, hydroxyethyl, propyl, and the like, benzyl and mixtures thereof; each $R^2$ is a long chain, saturated and/or unsaturated (Iodine Value—"IV" of from about 3 to about 60), $C_8$–$C_{30}$ hydrocarbyl, or substituted hydrocarbyl substituent and mixtures thereof; $R^3$ is R or H; and the counterion, X—, can be any softener-compatible anion, for example, methylsulfate, ethylsulfate, chloride, bromide, formate, sulfate, lactate, nitrate and the like, preferably methylsulfate.

It will be understood that substituents R and $R^2$ of Formula I can optionally be substituted with various groups such as alkoxyl or hydroxyl groups.

The preferred ester linked compounds (DEQA) can be considered to be diester variations of ditallow dimethyl ammonium chloride (DTDMAC), which is a widely used fabric softener. Preferably, at least 80% of the DEQA is in the diester form, and from 0% to about 20%, preferably less than about 10%, more preferably less than about 5%, can be DEQA monoester (e.g., only one —Y—$R^2$ group). For optimal antistatic benefit monoester should be low, preferably less than about 2.5%. The level of monoester can be controlled in the manufacturing of the DEQA.

The quaternary softening compounds with at least partially unsaturated alkyl or acyl groups have advantages (i.e., antistatic benefits) and are highly acceptable for consumer products when certain conditions are met. Antistatic effects are especially important where the fabrics are dried in a tumble dryer, and/or where synthetic materials which generate static are used. Any reference to IV values hereinafter refers to IV of fatty alkyl or acyl groups and not to the resulting quaternary, e.g., DEQA compound. As the IV is raised, there is a potential for odor problems.

For unsaturated softener actives, the optimum storage temperature for stability and fluidity depends on the specific IV of, e.g., the fatty acid used to make DEQA and/or the level/type of solvent selected. Exposure to oxygen should be minimized to keep the unsaturated groups from oxidizing. It can therefore be important to store the material under a reduced oxygen atmosphere such as a nitrogen blanket. It is important to provide good molten storage stability to provide a commercially feasible raw material that will not degrade noticeably in the normal transportation/storage/handling of the material in manufacturing operations.

The following are non-limiting examples of DEQA Formula I (wherein all long-chain alkyl substituents are straight-chain):

Saturated $$[C_2H_5]_2^{\oplus}N[CH_2CH_2OC(O)C_{17}H_{35}]_2SO_4CH_3^{\ominus}$$

$$[C_3H_7][C_2H_5]^{\oplus}N[CH_2CH_2OC(O)C_{11}H_{23}]_2SO_4^{\ominus}CH_3$$

$$[CH_3]_2^{\oplus}N[CH_2CH_2OC(O)R^2]_2SO_4CH_3^{\ominus}$$

where —C(O)$R^2$ is derived from saturated tallow.

Unsaturated $$[CH_3]_2^{\oplus}N[CH_2CH_2OC(O)C_{17}H_{33}]_2SO_4^{\oplus}CH_3$$

$$[C_2H_5]_2^{\oplus}N[CH_2CH_2OC(O)C_{17}H_{33}]_2Cl^{\ominus}$$

$$[CH_2CH_2OH][CH_3]^{\oplus}N[CH_2CH_2OC(O)R^2]_2CH_3SO_4^{\ominus}$$

$$[CH_3]_2^{\oplus}N[CH_2CH_2OC(O)R^2]_2CH_3SO_4^{\ominus}$$

where —C(O)$R^2$ is derived from partially hydrogenated tallow or modified tallow having the characteristics set forth herein.

In addition to Formula I compounds, the compositions and articles of the present invention comprise DEQA compounds of Formula II:

$$N^{\ominus}(R^1)_3—(CH_2)_n—CH(Q—T^1)—CH_2(Q—T^2)X^{\oplus}$$

wherein, for any molecule:

each Q is —O—C(O)— or —(O)C—O—;

each $R^1$ is $C_1$–$C_4$ alkyl or hydroxy alkyl;

each $T^1$ and $T^2$ is a $C_8$–$C_{30}$ alkyl or alkenyl group;

n is an integer from 1 to 4; and $X^{\ominus}$ is a softener-compatible anion; and wherein preferably $R^1$ is a methyl group, n is 1, Q is —O—C(O)—, $T^1$ and $T^2$ are $C_{14}$–$C_{18}$, and $X^{\ominus}$ is methyl sulfate.

The straight or branched alkyl or alkenyl chains, $T^1$ and $T^2$, have from about 8 to about 30 carbon atoms, preferably from about 14 to about 18 carbon atoms, more preferably straight chains having from about 14 to about 18 carbon atoms.

These compounds can be prepared by standard esterification and quaternization reactions, using readily available starting materials. General methods for preparation are disclosed in U.S. Pat. No. 4,137,180, incorporated herein by reference.

(3) Optional Soil Release Agent

Optionally, the compositions herein contain from 0% to about 10%, preferably from about 0.1% to about 5%, more preferably from about 0.1% to about 2%, of a soil release agent. Preferably, such a soil release agent is a polymer. Polymeric soil release agents useful in the present invention include copolymeric blocks of terephthalate and polyethylene oxide or polypropylene oxide, and the like. U.S. Pat. No. 4,956,447, Gosselink/Hardy/Trinh, issued Sep. 11, 1990, discloses specific preferred soil release agents comprising cationic functionalities, said patent being incorporated herein by reference.

A preferred soil release agent is a copolymer having blocks of terephthalate and polyethylene oxide. More specifically, these polymers are comprised of repeating units of ethylene and/or propylene terephthalate and polyethylene oxide terephthalate at a molar ratio of ethylene terephthalate units to polyethylene oxide terephthalate units of from about 25:75 to about 35:65, said polyethylene oxide terephthalate containing polyethylene oxide blocks having molecular weights of from about 300 to about 2000. The molecular weight of this polymeric soil release agent is in the range of from about 5,000 to about 55,000.

U.S. Pat. No. 4,976,879, Maldonado/Trinh/Gosselink, issued Dec. 11, 1990, discloses specific preferred soil release agents which can also provide improved antistat benefit, said patent being incorporated herein by reference.

Another preferred polymeric soil release agent is a crystallizable polyester with repeat units of ethylene terephthalate units containing from about 10% to about 15% by weight of ethylene terephthalate units together with from about 10% to about 50% by weight of polyoxyethylene terephthalate units, derived from a polyoxyethylene glycol of average molecular weight of from about 300 to about 6,000, and the molar ratio of ethylene terephthalate units to polyoxyethylene terephthalate units in the crystallizable polymeric compound is between 2:1 and 6:1. Examples of this polymer include the commercially available materials Zelcon® 4780 (from DuPont) and Milease® T (from ICI).

A more complete disclosure of these highly preferred soil release agents is contained in European Pat. Application 185,427, Gosselink, published Jun. 25, 1986, incorporated herein by reference.

(4) Cyclodextrin/Perfume Complexes and Free Perfume

The products herein can also contain from about 0.5% to about 60%, preferably from about 1% to about 50%, cyclodextrin/perfume inclusion complexes, as disclosed in U.S. Pat. Nos. 5,139,687, Borcher et al., issued Aug. 18, 1992; and 5,234,610, Gardlik et al., to issue Aug. 10, 1993, which are incorporated herein by reference. Perfumes are highly desirable, can usually benefit from protection, and can be complexed with cyclodextrin. Fabric softening products typically contain perfume to provide an olfactory aesthetic benefit and/or to serve as a signal that the product is effective.

The perfume ingredients and compositions of this invention are the conventional ones known in the art. Selection of any perfume component, or amount of perfume, is based solely on aesthetic considerations. Suitable perfume compounds and compositions can be found in the art including U.S. Pat. Nos.: 4,145,184, Brain and Cummins, issued Mar. 20, 1979; 4,209,417, Whyte, issued Jun. 24, 1980; 4,515,705, Moeddel, issued May 7, 1985; and 4,152,272, Young, issued May 1, 1979, all of said patents being incorporated herein by reference. Many of the art recognized perfume compositions are relatively substantive, as described hereinafter, to maximize their odor effect on substrates. However, it is a special advantage of perfume delivery via the perfume/cyclodextrin complexes that nonsubstantive perfumes are also effective. The volatility and substantivity of perfumes is disclosed in U.S. Pat. No. 5,234,610, supra.

If a product contains both free and complexed perfume, the escaped perfume from the complex contributes to the overall perfume odor intensity, giving rise to a longer lasting perfume odor impression.

As disclosed in U.S. Pat. No. 5,234,610, supra, by adjusting the levels of free perfume and perfume/CD complex it is possible to provide a wide range of unique perfume profiles in terms of timing (release) and/or perfume identity (character). Solid, dryer-activated fabric conditioning compositions are a uniquely desirable way to apply the cyclodextrins, since they are applied at the very end of a fabric treatment regimen when the fabric is clean and when there are almost no additional treatments that can remove the cyclodextrin.

(5) Stabilizers

Stabilizers can be present in the compositions of the present invention. The term "stabilizer," as used herein, includes antioxidants and reductive agents. These agents are present at a level of from 0% to about 2%, preferably from about 0.01% to about 0.2%, more preferably from about 0.05% to about 0.1% for antioxidants and more preferably from about 0.01% to about 0.2% for reductive agents. These assure good odor stability under long term storage conditions for the compositions. Use of antioxidants and reductive agent stabilizers is especially critical for unscented or low scent products (no or low perfume).

Examples of antioxidants that can be added to the compositions of this invention include ascorbic acid, ascorbic palmitate, propyl gallate, available from Eastman Chemical Products, Inc., under the trade names Tenox® PG and Tenox S-1; a mixture of BHT, BHA, propyl gallate, and citric acid, available from Eastman Chemical Products, Inc., under the trade name Tenox-6; butylated hydroxytoluene, available from UOP Process Division under the trade name Sustane® BHT; tertiary butylhydroquinone, Eastman Chemical Products, Inc., as Tenox TBHQ; natural tocopherols, Eastman Chemical Products, Inc., as Tenox GT-1/GT-2; and butylated hydroxyanisole, Eastman Chemical Products, Inc., as BHA.

Examples of reductive agents include sodium borohydride, hypophosphorous acid, and mixtures thereof.

The stability of the compounds and compositions herein can be helped by the stabilizers, but in addition, the preparation of compounds used herein and the source of hydrophobic groups can be important. Surprisingly, some highly desirable, readily available sources of hydrophobic groups such as fatty acids from, e.g., tallow, possess odors that remain with the compound, e.g., DEQA despite the chemical and mechanical processing steps which convert the raw tallow to finished DEQA. Such sources must be deodorized, e.g., by absorption, distillation (including stripping such as steam stripping), etc., as is well known in the art. In addition, care must be taken to minimize contact of the resulting fatty acyl groups to oxygen and/or bacteria by adding antioxidants, antibacterial agents, etc. The additional expense and effort associated with the unsaturated fatty acyl groups is justified by the superior performance which has not been recognized.

(6) Other Optional Ingredients

The present invention can include other optional components (minor components) conventionally used in textile treatment compositions, for example, colorants, preservatives, optical brighteners, opacifiers, physical stabilizers such as guar gum and polyethylene glycol, anti-shrinkage agents, anti-wrinkle agents, fabric crisping agents, spotting agents, germicides, fungicides, anti-corrosion agents, antifoam agents, and the like.

(D) Substrate Articles

In preferred embodiments, the present invention encompasses articles of manufacture. Representative articles are those that are adapted to soften fabrics in an automatic laundry dryer, of the types disclosed in U.S. Pat. Nos.: 3,989,631 Marsan, issued Nov. 2, 1976; 4,055,248, Marsan, issued Oct. 25, 1977; 4,073,996, Bedenk et al., issued Feb. 14, 1978; 4,022,938, Zaki et al., issued May 10, 1977; 4,764,289, Trinh, issued Aug. 16, 1988; 4,808,086, Evans et al., issued Feb. 28,1989; 4,103,047, Zaki et al., issued Jul. 25, 1978; 3,736,668, Dillarstone, issued Jun. 5, 1973; 3,701,202, Compa et al., issued Oct. 31,1972; 3,634,947, Furgal, issued Jan. 18, 1972; 3,633,538, Hoeflin, issued Jan. 11, 1972; and 3,435,537, Rumsey, issued Apr. 1, 1969; and 4,000,340, Murphy et al., issued Dec. 28, 1976, all of said patents being incorporated herein by reference.

In a preferred substrate article embodiment, the fabric treatment compositions are provided as an article of manufacture in combination with a dispensing means such as a flexible substrate which effectively releases the composition in an automatic laundry (clothes) dryer. Such dispensing means can be designed for single usage or for multiple uses. The dispensing means can also be a "carrier material" that releases the fabric softener composition and then is dispersed and/or exhausted from the dryer.

The dispensing means will normally carry an effective amount of fabric treatment composition. Such effective amount typically provides sufficient fabric conditioning/antistatic agent and/or anionic polymeric soil release agent for at least one treatment of a minimum load in an automatic laundry dryer. Amounts of fabric treatment composition for multiple uses, e.g., up to about 30, can be used. Typical amounts for a single article can vary from about 0.25 g to about 100 g, preferably from about 0.5 g to about 20 g, most preferably from about 1 g to about 10 g.

Highly preferred paper, woven or nonwoven "absorbent" substrates useful herein are fully disclosed in U.S. Pat. No. 3,686,025, Morton, issued Aug. 22, 1972, incorporated herein by reference. It is known that most substances are able to absorb a liquid substance to some degree; however, the term "absorbent" as used herein, is intended to mean a substance with an absorbent capacity (i.e., a parameter representing a substrate's ability to take up and retain a liquid) from 4 to 12, preferably 5 to 7, times its weight of water.

Another article comprises a sponge material releasably enclosing enough fabric treatment composition to effectively impart fabric soil release, antistatic effect and/or softness benefits during several cycles of clothes. This multi-use article can be made by filling a hollow sponge with about 20 grams of the fabric treatment composition.

(E) Usage

The substrate embodiment of this invention can be used for imparting the above-described fabric treatment composition to fabric to provide softening and/or antistatic effects to fabric in an automatic laundry dryer, Generally, the method of using the composition of the present invention comprises: commingling pieces of damp fabric by tumbling said fabric under heat in an automatic clothes dryer with an effective amount of the fabric treatment composition. At least the continuous phase of said composition has a melting point greater than about 35° C. and the composition is flowable at dryer operating temperature. This composition comprises from about 5% to about 90%, preferably from about 10% to about 75%, of the ethoxylated sugar derivative and from about 10% to about 95%, preferably from about 20% to about 75%, more preferably from about 20% to about 60% of the above-defined co-softeners.

The present invention relates to improved solid dryer-activated fabric softener compositions which are either (A) incorporated into articles of manufacture in which the compositions are, e.g., on a substrate, or are (B) in the form of particles (including, where appropriate, agglomerates, pellets, and tablets of said particles).

All percentages, ratios, and parts herein, in the Specification, Examples, and claims, are by weight and approximations unless otherwise stated.

The following are nonlimiting examples of the instant articles, methods, and compositions of the present invention.

EXAMPLE 1

| Components | Wt. % |
|---|---|
| Co-softener* | 27.21 |
| Glycosperse S-20 | 17.44 |
| Perfume/Cyclodextrin Complex | 16.04 |
| Clay** | 3.14 |
| Free Perfume | 1.29 |
| Sobitan Monostearate | 34.88 |
| | 100.0 |

Glycosperse S-20 is polyethoxylated sorbitan monostearate, from Lonza, which contains about 20 ethoxylate moieties per molecule.
*1:2 ratio of stearyldimethylamine:triple-pressed stearic acid.
**Calcium bentonite clay, Bentolite ® L, sold by Southern Clay Products, or Gelwhite ® GP clay.

Preparation of the Coating Mix

An approximately 200 g batch of the coating mix is prepared as follows. An amount of about 54 g of co-softener and about 70 g of sorbitan monostearate (SMS) are melted separately at about 80° C. Separately, about 35 g of Glycosperse S-20 is also melted at about 80° C. The co-softener/SMS blend and Glycosperse S-20 are then combined with high shear mixing. During the mixing, the mixture is kept molten in a hot water bath at about 70°-80° C. The complex (about 32 g) is ground and slowly added to the mixture with high shear mixing. The calcium bentonite clay (about 6 g) is slowly added to the mixture with high shear mixing until the desired viscosity is achieved. The perfume (about 3 g) is added to the mixture, and the formula is mixed until the mixture is smooth and homogeneous.

Preparation of Fabric Conditioning Sheets

The coating mixture is applied to preweighed substrate sheets of about 6.75 inches ×12 inches (approximately 17 cm ×30 cm) dimensions. The substrate sheets are comprised of about 4-denier spun bonded polyester. A small amount of the formula is placed on a heated metal plate with a spatula and then is spread evenly with a wire metal rod. A substrate sheet is placed on the metal plate to absorb the coating mixture. The sheet is then removed from the heated metal plate and allowed to cool to room temperature so that the coating mix can solidify. The sheet is weighed to determine the amount of coating mixture on the sheet. The target sheet weight is 3.38 g. If the weight is in excess of the target weight, the sheet is placed back on the heated metal plate to remelt the coating mixture and remove some of the excess. If the weight is under the target weight, the sheet is also placed on the heated metal plate and more coating mixture is added.

EXAMPLE 2

The coating mix preparation and the making of the fabric conditioning sheets are similar to those in Example 1, except that Glycosperse S-5 is used instead of Glycosperse S-20.

EXAMPLE 3

The coating mix preparation and the making of the fabric conditioning sheets are similar to those in Example 1, except that Glycosperse S-10 is used instead of Glycosperse S-20.

EXAMPLE 4

| Components | Wt. % |
|---|---|
| Co-softener* | 43.15 |
| Glycosperse S-20 | 49.84 |
| Clay** | 5.39 |
| Free Perfume | 1.62 |
| | 100.0 |

*1:2 ratio of stearyldimethylamine:triple-pressed stearic acid.
**Calcium bentonite clay, Bentolite L, sold by Southern Clay Products, or Gelwhite GP clay.

The coating mix preparation and the making of the fabric conditioning sheets are similar to those in Example 1, except that the target sheet weight is 2.85 g.

EXAMPLE 5

The coating mix preparation and the making of the fabric conditioning sheets are similar to those in Example 4, except that Glycosperse S-15 is used instead of Glycosperse S-20.

EXAMPLE 6

| Components | Wt. % |
|---|---|
| Glycosperse S-20 | 94.59 |
| Clay** | 5.41 |
| | 100.0 |

**Calcium bentonite clay, Bentolite L, sold by Southern Clay Products, or Gelwhite GP clay The coating mix preparation and the making of the fabric conditioning sheets are similar to those in Example 1.

EXAMPLE 7

The coating mix preparation and the making of the fabric conditioning sheets are similar to those in Example 1, except that the co-softener is a 1:2 ratio of oleyldimethylamine to triple-pressed stearic acid instead of stearyldimethylamine and triple-pressed stearic acid.

EXAMPLE 8

| Components | Wt. % |
|---|---|
| Co-softener* | 27.21 |
| Sorbitan Monostearate | 17.44 |
| Glycosperse S-20 | 17.44 |
| Perfume/Cyclodextrin Complex | 16.04 |
| Clay** | 3.14 |

-continued

| Components | Wt. % |
|---|---|
| Free Perfume | 1.29 |
| Dimethyl Bis(oleyloxyethyl) Ammonium Methyl Sulfate | 17.44 |
| | 100.0 |

Glycosperse S-20 is polyethoxylated sorbitan monostearate, from Lonza, which contains about 20 ethoxylate moieties per molecule.
*1:2 ratio of stearyldimethylamine:triple-pressed stearic acid.
**Calcium bentonite clay, Bentolite L, sold by Southern Clay Products, or Gelwhite GP clay The coating mix preparation and the making of the fabric conditioning sheets are similar to those in Example 1.

What is claimed is:

1. A dryer-activated fabric conditioning composition comprising:

(A) at least about 5% of alkoxylated sugar derivative containing a sugar moiety, at least about 5 ethylene oxide, propylene oxide, or mixtures thereof, groups per molecule and at least one long hydrophobic moiety, containing from about 8 to about 30 carbon atoms, per molecule; and (B) from 0% to about 95% of a co-softener comprising a carboxylic acid salt of a tertiary amine.

2. The composition of claim 1 wherein, in (A), said highly alkoxylated sugar derivative contains from about 5 to about 40 ethylene oxide groups per molecule, the sugar moiety is sorbitan, there are from one to about 3 hydrophobic moieties which are part of fatty acyl groups containing from about 12 to about 22 carbon atoms, attached to the sugar moiety by ester linkages.

3. The composition of claim 1 wherein the co-softener (B) contains unsaturated fatty acyl groups.

4. The composition of claim 3 wherein said carboxylic acid salt of a tertiary amine is prepared using a fatty acid selected from the group consisting of lauric, myristic, palmitic, steric, oleic and mixtures thereof.

5. The composition of claim 4 wherein said co-softener is selected from the group consisting of oleyldimethylamine stearate, dioleylmethylamine stearate, linoleyldimethylamine stearate, dilinoleylmethylamine stearate, stearyldimethylamine stearate, distearylmethylamine myristate, stearyldimethylamine palmitate, distearylmethylamine palmitate, distearylmethylamine myristate, distearylmethylamine laurate, distearylmethylamine oleate, and mixtures thereof.

6. The composition of claim 5 wherein said co-softener comprises a mixture of oleyldimethylamine stearate and distearylmethylamine myristate in a weight ratio of from 1:10 to 10:1.

7. The composition of claim 1 additionally comprising (C) from about 15% to about 40% of $C_{10}$–$C_{26}$ acyl sorbitan monoester, diester, and mixtures thereof; wherein the composition has a melting point of from about 50° C. to about 80° C.

8. The composition of claim 7 wherein (C) is sorbitan monooleate.

9. The composition of claim 7 wherein the ratio of A:B:C is 1:1.56:2.

10. The composition of claim 9 wherein the composition additionally comprises from 0% to about 2% of a stabilizer selected from the group consisting of ascorbic acid, ascorbic palmitate, propyl gallate, butylated hydroxytoluene, tertiary butylhydroquinone, natural tocopherols, butylated hydroxyanisole, citric acid, isopropyl citrate, and mixtures thereof; from 0% to about 10% of a soil release polymer; and mixtures thereof.

11. The composition of claim 7 additionally comprising a quaternary ammonium compound selected from the group consisting of:

Formula I which comprises:

$$(R)_{4-m}-N^+-[(CH_2)_n-(Y)_p-R^2]_mX^-$$

wherein each Y=—O—(O)C—, —N(R)$^3$—C(O)—, —C(O)—N(R)$^3$—, or —C(O)—O—; m=1 to 3; n=1 to 4; p=0 or 1; each R substituent is a short chain $C_1$–$C_6$ alkyl or hydroxy alkyl group; each $R^2$ is a long chain, $C_8$–$C_{30}$ hydrocarbyl, or substituted hydrocarbyl substituent and mixtures thereof; $R^3$ is R or H: and the counterion. $X^-$, can be any softener-compatible anion;

Formula II which comprises:

$$N^+(R^1)_3-(CH_2)_n-CH(Q-T^1)-CH_2(Q-T^2)X^-$$

wherein, for any molecule, each Q is —O—C(O)—, or —(O)C—O—; each $R^1$ is $C_1$–$C_4$ alkyl or hydroxy alkyl; each $T^1$ and $T^2$ is a $C_8$–$C_{30}$ alkyl or alkenyl group; n is an integer from 1 to 4; and $X^-$ is a softener-compatible anion; and mixtures thereof.

12. The composition of claim 11 wherein said quaternary ammonium compound is selected from the group consisting of: $[C_2H_5]_2+N[CH_2CH_2OC(O)C_{17}H_{35}]_2$ $SO_4CH_3^-$; $[C_3H_7][C_2H_5]+N[CH_2CH_2OC(O)C_{11}H_{23}]_2$ $SO_4^-CH_3$; $[CH_3]_2+N[CH_2CH_2OC(O)R^2]_2$ $SO_4CH_3^-$; or mixtures thereof where —C(O)$R^2$ is derived from saturated tallow; and $[CH_3]_2+N[CH_2CH_2OC(O)C_{17}H_{33}]_2$ $SO_4^-CH_3$; $[C_2H_5]_2+N[CH_2CH_2OC(O)C_{17}H_{33}]_2$ $Cl^-$; $[CH_2CH_2OH][CH_3]+N[CH_2CH_2OC(O)R^2]_2$ $CH_3SO_4^-$; $[CH_3]_2+N[CH_2CH_2OC(O)R^2]_2$ $CH_3SO_4^-$; and mixtures thereof where —C(O)$R^2$ is derived from partially hydrogenated tallow; and mixtures thereof.

13. The composition of claim 11 wherein said quaternary ammonium compound is selected from the group consisting of: dimethylbis(oleyloxyethyl)ammonium methyl sulfate; dimethylbis(cocoyloxyethyl)ammonium methyl sulfate; dimethylbis(tallowyloxyethyl)ammonium methyl sulfate; and mixtures thereof.

14. The composition of claim 1 containing from about 10% to about 90% of (A) and from about 10% to about 75% of (B).

15. The composition of claim 14 containing from about 10% to about 60% of (B).

16. The composition of claim 15 additionally comprising a quaternary ammonium compound selected from the group consisting of Formula I which comprises:

$$(R)_{4-m}-N^+-[(CH_2)_n-(Y)_p-R^2]_mX^-$$

wherein each Y=—O—(O)C—, —N(R)$^3$—C(O)—, —C(O)—N(R)$^3$—, or —C(O)—O—; m=1 to 3; n=1 to 4; p=0 or 1; each R substituent is a short chain $C_1$–$C_6$ alkyl or hydroxy alkyl group; each $R^2$ is a long chain, $C_8$–$C_{30}$ hydrocarbyl, or substituted hydrocarbyl substituent and mixtures thereof; $R^3$ is R or H; and the counterion, $X^-$, can be any softener-compatible anion;

Formula II which comprises:

$$N^+(R^1)_3-(CH_2)_n-CH(Q-T^1)-CH_2(Q-T^2)X^-$$

wherein, for any molecule, each Q is —O—C(O)—, or —(O)C—O—; each $R^1$ is $C_1$–$C_4$ alkyl or hydroxy alkyl; each $T^1$ and $T^2$ is a $C_8$–$C_{30}$ alkyl or alkenyl group; n is an integer from 1 to 4; and $X^-$ is a softener-compatible anion; and mixtures thereof.

17. The composition of claim 1 containing from about 10% to about 75% of (A) and from about 20% to about 60% of (B).

18. The composition of claim 17 containing from about 15% to about 55% of (A).

19. The composition of claim 17 wherein, in (A), said highly alkoxylated sugar derivative contains from about 5 to about 40 EO groups per molecule, the sugar moiety is sorbitan, there are from one to about 3 hydrophobic moieties which are part of fatty acyl groups containing from about 12 to about 22 carbon atoms, attached to the sugar moiety by ester linkages.

20. The composition of claim 19 wherein said carboxylic acid salt of a tertiary amine is prepared using a fatty acid is selected from the group consisting of lauric, myristic, palmitic, stearic, oleic and mixtures thereof.

21. The composition of claim 19 wherein said co-softener is selected from the group consisting of oleyldimethylamine stearate, dioleylmethylamine stearate, linoleyldimethylamine stearate, dilinoleylmethylamine stearate, stearyldimethylamine stearate, distearylmethylamine myristate, stearyldimethylamine palmitate, distearylmethylamine palmitate, distearylmethylamine myristate, distearylmethylamine laurate, distearylmethylamine oleate, and mixtures thereof.

22. The composition of claim 19 wherein said co-softener comprises a mixture of oleyldimethylamine stearate and distearylmethylamine myristate in a weight ratio of from 1:10 to 10:1.

23. The composition of claim 17 additionally comprising (C) from about 15% to about 40% of $C_{10}$–$C_{26}$ acyl sorbitan monoester, diester, and mixtures thereof; wherein the composition has a melting point of from about 50° C. to about 80° C.

24. The composition of claim 23 additionally comprising a quaternary ammonium compound selected from the group consisting of:

Formula I which comprises:

$$(R)_{4-m}-N^+-[(CH_2)_n-(Y)_p-R^2]_mX^-$$

wherein each Y=—O—(O)C—, —N(R)$^3$—C(O)—, —C(O)—N(R)$^3$—, or —C(O)—O—; m=1 to 3; n=1 to 4; p=0 or 1; each R substituent is a short chain $C_1$–$C_6$ alkyl or hydroxy alkyl group; each $R^2$ is a long chain, $C_8$–$C_{30}$ hydrocarbyl, or substituted hydrocarbyl substituent and mixtures thereof; $R^3$ is R or H; and the counterion, $X^-$, can be any softener-compatible anion;

Formula II which comprises:

$$N^+(R^1)_3-(CH_2)_n-CH(Q-T^1)-CH_2(Q-T^2)X^-$$

wherein, for any molecule, each Q is —O—C(O)—, or —(O)C—O—; each $R^1$ is $C_1$–$C_4$ alkyl or hydroxy alkyl; each $T^1$ and $T^2$ is a $C_8$–$C_{30}$ alkyl or alkenyl group; n is an integer from 1 to 4; and $X^-$ is a softener-compatible anion; and mixtures thereof.

25. The composition of claim 24 wherein said quaternary ammonium compound is selected from the group consisting of: $[C_2H_5]_2+N[CH_2CH_2OC(O)C_{17}H_{35}]_2$ $SO_4CH_3^-$; $[C_3H_7][C_2H_5]+N[CH_2CH_2CO(O)C_{11}H_{23}]_2$ $SO_4^-CH_3$; $[CH_3]_2+N[CH_2CH_2OC(O)R^2]_2$ $SO_4CH_3^-$; or mixtures thereof where —C(O)$R^2$ is derived from saturated tallow; and $[CH_3]_2+N[CH_2CH_2OC(O)C_{17}H_{33}]_2$ $SO_4^-CH_3$; $[C_2H_5]_2+N[CH_2CH_2OC(O)C_{17}H_{33}]_2$ $Cl^-$; $[CH_2CH_2OH][CH_3]+N[CH_2C$-

$H_2OC(O)R^2]_2$ $CH_3SO_4^-$; $[CH_3]_2+N[CH_2CH_2OC(O)R^2]_2$ $CH_3SO_4^-$; and mixtures thereof where —C(O)$R^2$ is derived from partially hydrogenated tallow; and mixtures thereof.

26. The composition of claim 1 additionally comprising a quaternary ammonium compound selected from the group consisting of:

Formula I which comprises:

$$(R)_{4-m}—N^+—[(CH_2)_n—(Y)_p—R^2]_mX^-$$

wherein each Y=—O—(O)C—, —N(R)$^3$—C(O)—, —C(O)—N(R)$^3$—, or —C(O)—O—; m=1 to 3; n=1 to 4; p=0 or 1; each R substituent is a short chain $C_1$–$C_6$ alkyl or hydroxy alkyl group; each $R^2$ is a long chain, $C_8$–$C_{30}$ hydrocarbyl, or substituted hydrocarbyl substituent and mixtures thereof; $R^3$ is R or H; and the counterion, $X^-$, can be any softener-compatible anion;

Formula II which comprises:

$$N^+(R^1)_3—(CH_2)_n—CH(Q—T^1)—CH_2(Q—T^2)X^-$$

wherein, for any molecule, each Q is —O—C(O)—, or —(O)C—O—; each $R^1$ is $C_1$–$C_4$ alkyl or hydroxy alkyl; each $T^1$ and $T^2$ is a $C_8$–$C_{30}$ alkyl or alkenyl group; n is an integer from 1 to 4; and $X^-$ is a softener-compatible anion; and mixtures thereof.

27. The composition of claim 26 wherein said quaternary ammonium compound is selected from the group consisting of: $[C_2H_5]_2+N[CH_2CH_2OC(O)C_{17}H_{35}]_2$ $SO_4CH_3^-$; $[C_3H_7][C_2H_5]+N[CH_2CH_2OC(O)C_{11}H_{23}]_2$ $SO_4^-CH_3$; $[CH_3]_2+N[CH_2CH_2OC(O)R^2]_2$ $SO_4CH_3^-$; or mixture thereof where —C(O)$R^2$ is derived from saturated tallow; and $[CH_3]_2+N[CH_2CH_2OC(O)C_{17}H_{33}]_2$ $SO_4^-CH_3$; $[C_2H_5]_2+N[CH_2CH_2OC(O)C_{17}H_{33}]_2$ $Cl^-$; $[CH_2CH_2OH][CH_3]+N[CH_2CH_2OC(O)R^2]_2$ $CH_3SO_4^-$; $[CH_3]_2+N[CH_2CH_2OC(O)R^2]_2$ $CH_3SO_4^-$; and mixtures thereof where —C(O)$R^2$ is derived from partially hydrogenated tallow; and mixtures thereof.

28. The composition of claim 27 wherein said quaternary ammonium compound is $[CH_2CH_2OH][CH_3]+N[CH_2CH_2OC(O)R^2]_2$ $CH_3SO_4^-$ where —C(O)$R^2$ is derived from partially hydrogenated tallow.

29. The composition of claim 27 wherein said quaternary ammonium compound is $[CH_3]_2-N[CH_2CH_2OC(O)R^2]_2$ $CH_3SO_4^-$ where —C(O)$R^2$ is derived from partially hydrogenated tallow.

* * * * *